United States Patent [19]

Ikeda et al.

[11] Patent Number: 5,027,588

[45] Date of Patent: Jul. 2, 1991

[54] APPARATUS FOR SUBSTITUTING INERT GASES

[75] Inventors: Masaomi Ikeda, Yokohama; Yoshimi Terajima, Ebina; Nobuaki Nagatami, Yokohama; Hiroshi Akitoshi, Zushi, all of Japan

[73] Assignee: Toyo Seikan Kaisha Ltd., Tokyo, Japan

[21] Appl. No.: 261,967

[22] PCT Filed: Jul. 13, 1987

[86] PCT No.: PCT/JP87/00502

§ 371 Date: Sep. 21, 1988

§ 102(e) Date: Sep. 21, 1988

[87] PCT Pub. No.: WO89/00530

PCT Pub. Date: Jan. 26, 1989

[51] Int. Cl.[5] ..... B65B 31/04

[52] U.S. Cl. ..... 53/511; 53/88; 141/59; 141/64

[58] Field of Search ..... 53/79, 88, 101, 106, 53/403, 432, 433, 510, 511, 89, 110, 167; 141/59, 62, 63, 64

[56] References Cited

U.S. PATENT DOCUMENTS

| | | | |
|---|---|---|---|
| 2,054,492 | 9/1936 | Young | 53/510 X |
| 2,519,353 | 8/1950 | Cassady | 53/88 |
| 2,628,672 | 12/1952 | O'Neil | 53/510 X |
| 2,869,301 | 1/1959 | Stover | 53/110 |
| 2,931,147 | 4/1960 | Barnby | 53/510 X |
| 3,452,513 | 7/1969 | Owens | 53/510 X |
| 3,486,295 | 12/1969 | Rausing et al. | 53/167 X |
| 3,488,914 | 1/1970 | Csernak | 53/511 |
| 3,508,373 | 4/1970 | Robinson, Jr. | 53/86 |
| 3,815,322 | 6/1974 | Wyslotsky | 53/511 |
| 4,140,159 | 2/1979 | Domke | 53/510 X |
| 4,162,599 | 7/1979 | Kyle | 53/511 X |
| 4,312,171 | 1/1982 | Vadas | 53/510 X |
| 4,624,099 | 11/1986 | Harder | 53/432 |
| 4,685,274 | 8/1987 | Garwood | 53/511 X |
| 4,791,775 | 12/1988 | Rague et al. | 53/510 |
| 4,870,800 | 10/1989 | Kasai | 53/88 |

FOREIGN PATENT DOCUMENTS

| | | |
|---|---|---|
| 47-9947 | 5/1972 | Japan . |
| 50-16816 | 5/1975 | Japan . |
| 50-15432 | 6/1975 | Japan . |
| 56-131119 | 10/1981 | Japan . |

*Primary Examiner*—John Sipos
*Assistant Examiner*—Linda B. Johnson
*Attorney, Agent, or Firm*—Armstrong, Nikaido, Marmelstein, Kubovcik & Murray

[57] ABSTRACT

An inert gas substitution method comprising blowing an inert gas into a container in the state wherein an opening of a container is covered with an inert gas substitution apparatus (5, 20) having an inert gas blow opening (7, 30), thereby substituting the inert gas within the container, and after substitution, covering the opening of the container with a cover material film (15). An inert gas substitution apparatus (5) formed with an inert gas blow opening (7) and having a plate of which bottom surface is flat. An inert gas substitution apparatus (20) having a chamber (21) of which bottom surface is open, the chamber (21) covering an opening of a container to blow an inert gas into the container.

4 Claims, 3 Drawing Sheets

APPARATUS FOR SUBSTITUTING INERT GASES

TECHNICAL FIELD

The present invention relates to an apparatus for substituting an inert gas which substitutes an inert gas for air in a head space of a molded container filled with contents such as food.

BACKGROUND OF THE ART

Recently, in a food packaging, a gas-substitution packaging has been carried out which substitutes an inert gas for air surrounding food within a container before packaging in order to prevent food from being denatured or deteriorated due to oxygen.

Inert gases used for the above-described gas-substitution packaging are normally nitrogen or carbonic gas, and rarely a mixture of both the gases. This is effective in suppression of aerobic bacteria of the packaged food, retention of effective components, rancidity prevention, discoloration prevention, mold prevention and the like.

A conventional gas-substitution packaging has been carried out by inserting a packaged container filled with a content into a chamber capable of being closed, once making the interior of the chamber vacuous to remove air in the packaged container, thereafter blowing an inert gas into the chamber to fill a head space of a container with the inert gas, and sealing an opening of the container within the chamber.

Alternatively, a method has been carried out which comprises the steps of directly blowing an inert gas against an opening of a container being conveyed by a conveyor without producing a vaccum and deaeration, and substituting the inert gas for air within the head space.

In the above-described gas-substitution within the chamber, the inert gas is blown into the chamber after the latter has been once formed into vacuum, and therefore, it takes time, with the result that work efficiency is poor. Furthermore, since the inert gases are filled into the chamber every time, a large quantity of inert gases are required, resulting in a great loss of inert gases. Moreover, when the aforesaid conventional method is applied to a lateral type filling and sealing machine for a molded container which automatically carries out the step of filling a molded container with a content and sealing a cover, it is necessary to open and close the chamber as the conveyor conveying the molded container moves, position a conveyor portion on which the container is placed into the chamber to seal when closed. Therefore, there gives rise to a drawback in that the apparatus becomes complicated and expensive.

Alternatively, the method for directly blowing the inert gas without producing vacuum and deaeration to carry out gas-substitution poses problems in that not only the inert gases escape into atmosphere, increasing a loss of gases but also it is difficult to enhance the gassubstitution rate.

DISCLOSURE OF THE INVENTION

A primary object of this invention is to provide an apparatus for substituting an inert gas for a gas in a container, in a gas-substitution packaging, which involves less loss in inert gases to be supplied and in a short period of time and with high substitution rate.

A further object of this invention is to provide an apparatus for substituting an inert gas which can be easily applied to a horizontal type filling and sealing machine which transports a non-sealed molded container filled with a content by a conveyor and seals an opening thereof with a cover material film.

Another object of this invention is to provide a simple inert gas substitution apparatus which is simple in construction of the apparatus and which can be fabricated inexpensively.

The aforesaid object is achieved by an inert gas substitution apparatus characterized in that a plate having a bottom area to cover an opening of a container and which bottom is flat is formed with an inert gas blow hole, and an inert gas supply pipe is connected above said inert gas blow hole.

Further, the above-described object is achieved also by an inert gas substitution apparatus characterized in that a bottom-opened chamber is formed by side walls and a top wall, said side wall being provided with an inert gas blow hole and a gas exhaust hole, and an inert gas supply pipe is connected to the other end of said inert gas blow hole.

According to this invention, the opening of the non-sealed container filled with a content transported by the conveyor is covered with the inert gas substitution apparatus, and under this state the inert gas is directly blown into the container. Therefore, the inert gas can be substituted for the gas within the container in a short period of time and with high substitution rate whithout sealing the whole container in the chamber as experienced in prior art. The loss of inert gases is small.

Furthermore, according to this invention, the opening of the container is covered with the cover material film immediately after the substitution of the inert gas, and therefore, it is possible to cutoff the contact of the gas within the container after substitution with the external atmosphere.

Moreover, another merits of this invention lie in that they can be easily applied to the lateral type filling and sealing machine for transporting a molded container after being filed with the content to a sealing section to seal the opening of the container with the cover material film, and that the apparatus is simple and can be fabricated inexpensively.

BRIEF DESCRIPTION OF THE DRAWINGS

The drawings show embodiments of an inert gas substitution apparatus according to this invention, in which.

BEST MODE FOR EMBODYING THE INVENTION

Preferable embodiments of an inert gas substitution apparatus according to the present invention are shown in FIGS. 1 to 9.

An inert gas substitution apparatus according to the present embodiment is installed between a filling device and a sealing device in a known filling and sealing machine for filling a molded container with a content and sealing a cover. A molded container 1 is formed from a plastic, a laminated film of a metal foil and a plastic film or paper, and has a gas barrier property. The molded container 1 is filled with a content by a filling device not shown and conveyed below the gas substitution apparatus, which will be described hereinbelow, under the state wherein the container 1 is fitted and supported on a carriage 3 of a carriage conveyor 2.

Figure 1:
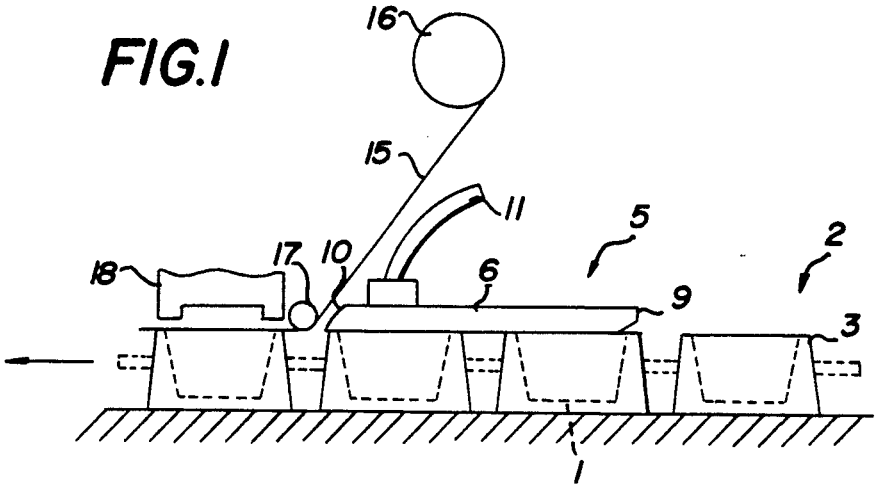
FIG. 1 is a side conceptual view applied to a lateral type filling and sealing machine for a molded container.
Figure 2:
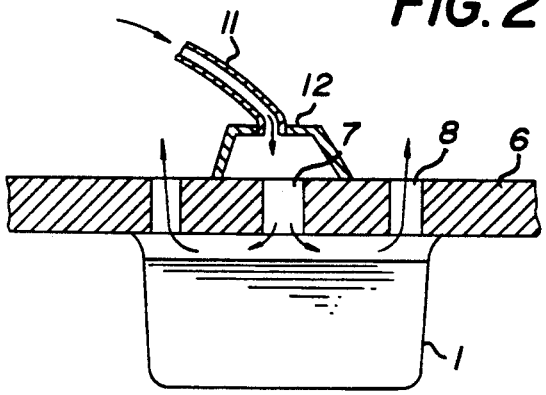
FIG. 2 is a fragmentary side sectional view of an inert gas substitution apparatus.
Figure 3:
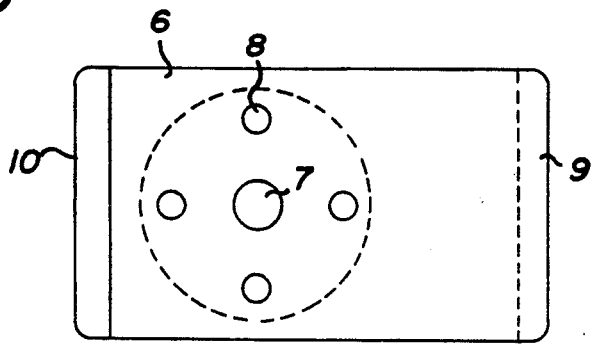
FIG. 3 is a plan view of an inert gas substitution apparatus.

A gas substitution apparatus 5 shown in FIGS. 1 to 3 is composed of a plate comprising a plastic flat plate 6 whose lower surface is smooth and having an approximately rectangular shape, and an inner gas supply pipe 11 having one end connected to an inner gas blow opening 7 bored in said flat plate 6 while the other end connected to a source of supplying an inert gas.

The flat plate 6 has the size enough to cover the opening of the container, and in the peripheral portion of the inert gas blow opening 7 are bored a plurality of air escape holes 8 within the range of the open area of the container. The flat plate 6 has its rear end edge, which is on the entering side of the molded container 1 conveyed by the conveyor, cornercut 9 in the form of an arc so that the molded container 1 conveyed by the conveyor may be smoothly moved into and below the flat plate. The foremost upper edge portion on the outlet side (that is, at the downstream) of the flat plate 6 is inclined through the approximately same angle as the supply angle of a cover material film 15 so that the foremost end edge 10 of flat plate 6 may be located in proximity of a film keep roll 17.

Reference numeral 11 designates an inert gas supply pipe connected to the inert gas blow opening 7 through a suitable connector 12, the other end thereof being connected to a source of supplying inert gases not shown.

The inert gas substitution apparatus 5 constructed as described above is secured upwardly of a conveyor 2 by a suitable mounting means at a level in close contact with an opening of the molded container 1 passing through the lower portion of the apparatus 5 and with the foremost end edge 10 placed in proximity of the keep roll 17.

Reference numeral 18 designates a sealer for heat-sealing the cover material film 15 on the opening of the container. The cover material film 15 is wound back from a supply roll 16 and guided so as to cover the opening of the container by the keep roll 17.

A preferred mode of embodiment of a method according to the present invention embodied by the above-described apparatus will be described hereinafter.

The molded container 1 filled with the content by a filling device not shown is intermittently conveyed while being fitted in and supported on the carrier 3 of the carrier conveyor 2, enters below the plastic flat plate 6 of the inert gas substitution apparatus and stops for a predetermined period of time when the center of the opening thereof reaches the lower portion of the gas blow opening 7. Then, the inert gases which are continuously blown from the gas blow opening 7 of the flat plate 6 are blown into the head space within the open container 1. As the result, air having been present within the head space of the open container 1 is discharged out of the air escape holes into outside and substituted for the inert gases.

After a predetermined period of time, the conveyor is again driven so that the molded container 1 with the inert gas substitution terminated moves while the open flanged portion thereof slidably contacting the bottom surface of the flat plate, and when the container 1 moves beyond the front end edge 10 of the flat plate 1, the container again moves while the opening thereof is covered with the cover film 15 at an extremely slight interval. Accordingly, the opening of the container 12 moved away from the foremost end of the flat plate 6 is immediately covered with the cover film 15, and therefore, the substituted gases are less escaped outside.

Thereafter, the sealer 18 is actuated in a known manner to cause the cover film 16 to be heat-sealed to the flanged portion of the container 1, and after sealing, the cover portion is trimmed from the cover film, thus completing sealing of the cover.

The apparatus used in the above-described embodiment was used to carry out the inert gas substitution under the following conditions.

| | |
|---|---|
| Processing ability of line: | 20 shot/min. |
| Container: | A 80 cc round type cup, into which 65 cc of water is put, a head space being 15 cc. |
| Cover material: | Aluminum packing material |
| Inert gas: | Nitrogen was continuously blown at 5 lit./min. |

As the result, the nitrogen was able to be substituted for air within the head space with the substitution rate of more or less 90 per cent.

While in the above-described embodiment, the air escape holes 8 are provided in the peripheral portion of the inert gas blow opening 7, it is to be noted that the air escape holes may not always be provided in the plate since air escapes from a contact portion between the open flanged portion of the container 1 and the bottom surface of the plate.

FIGS. 4 to 9 show another preferred embodiments of an inert gas substitution apparatus according to the present invention.

In the present embodiment, an inert gas substitution apparatus 20 is composed of a chamber 21, an inert gas supply path 22, an air exhaust path 23 and an opening covering member 28 of a molded container.

Figure 4:
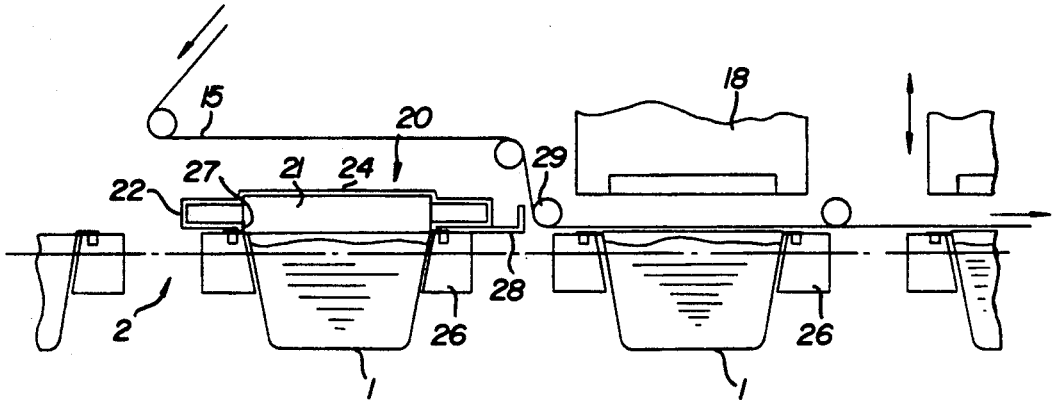
FIG. 4 is a side sectional view of another embodiment of an inert gas substitution apparatus according to the present invention applied to a lateral type filling and sealing machine for a molded container.
Figure 5:
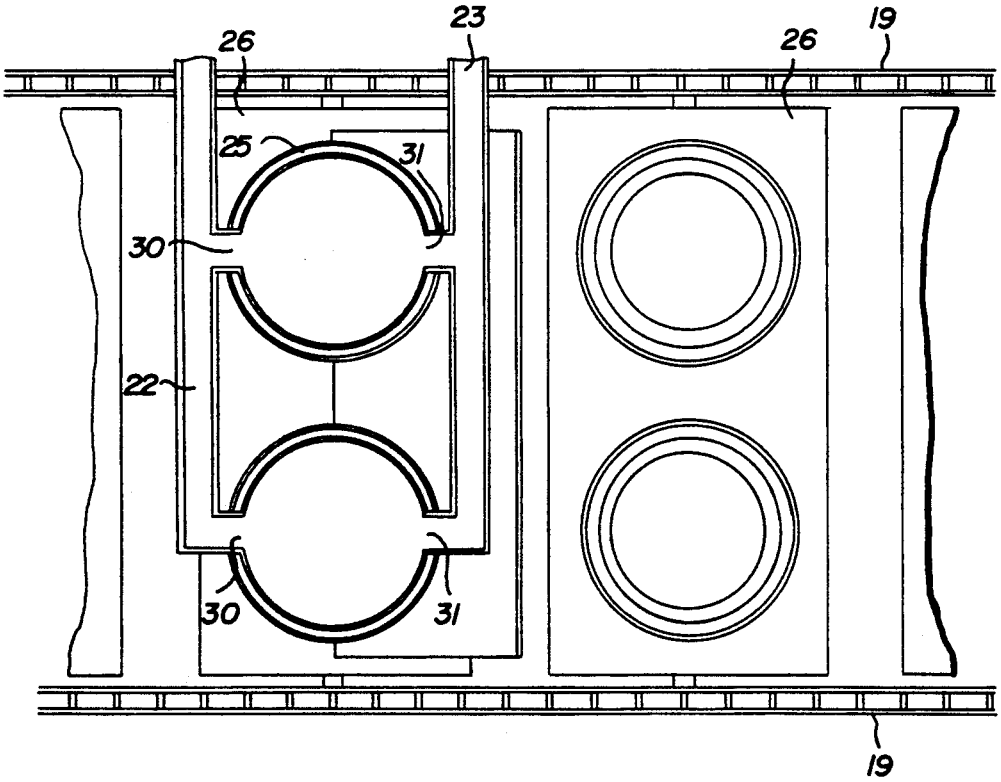
FIG. 5 is a plan view of apparatus shown in FIG. 4.

The chamber 21 has a bottom opened, and a top and a peripheral side surrounded by a top wall 24 and a side wall 25, respectively, the chamber 21 having its shape in the form of a cylinder or tube adjusted to the shape of an opening of a molded container for gas substitution. As shown in FIG. 4, a lower end 27 of the side wall 25 is to be positioned at the flanged portion of the molded container fitted in supported on the carriage 26. Accordingly, when the molded container 1 is positioned at the lower part of the chamber 21, the opening of the molded container 1 assumes a state where the opening is covered with the chamber 21.

If the shape of the opening of the molded container is a square, the shape of the chamber is formed so that a section thereof is a square.

At an upstream of a conveyor of the side wall 25 of the chamber 21 is provided an inert gas blow opening 30, and at a downstream thereof is provided an air exhaust opening 31, and with the blow opening 30 and the exhaust opening 31 are communicated an inert gas supply path 22 and an air exhaust path 23, respectively. A pipe from an inert gas cylinder not shown is connected to the other end of the inert gas supply path 22. A vacuum pump not shown is connected to the other end of the air exhaust path 23.

At a downstream of the conveyor at the lower end of the side wall of the chamber 21 is provided a cover member 28 so as to cover the opening of the molded container 1 till the molded container 1 moves from the lower portion of the chamber 21 and the opening thereof is covered with the cover material film 15. Accordingly, the cover member 28 extends to a position in proximity to a keep roller 29 of the cover material film.

In the illustrated embodiment, two chambers are provided in parallel with each other so that gas substitution may be simultaneously carried out for two molded containers, said two chambers, inert gas supply path 22, air exhaust path 23 and cover member 28 being manufactured from plastics.

Figure 6:
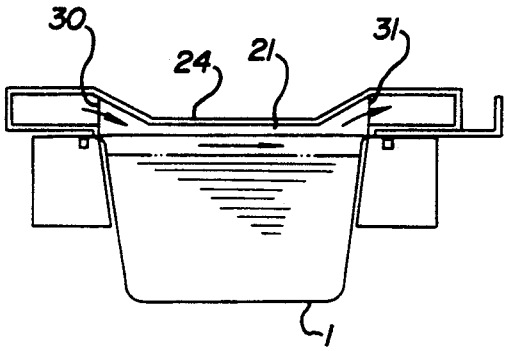
FIG. 6 is a side sectional view of apparatus shown in FIG. 4.
Figure 7:
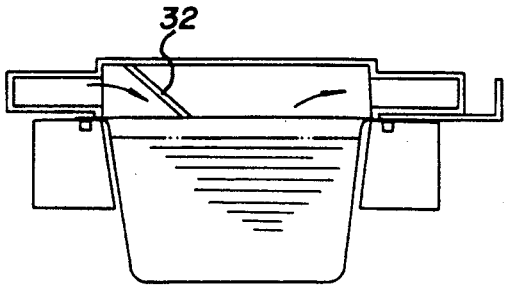
FIG. 7 is a side sectional view of another embodiment of an inert gas substitution apparatus.

The chamber 21 has its top wall 24 depressed as shown in FIG. 6 so that a flow of the inert gases blown out of the inert gas blow opening 30 may be deflected into the container 1. Thereby, the inert gases may be evenly blown into the head space of the molded container and the air may be efficiently discharged out of the air exhaust opening. In addition, the volume of the chamber 21 is decreased, and the gas substitution may be effectively carried out with a small quantity of inert gases. It is noted that as means for deflecting a flow of inert gases into the container, a gas flow deflecting plate 32 may be provided which is suspended obliquely toward the gas flow from the top wall as shown in FIG. 7.

The inert gas substitution apparatus 20 constructed as described above is secured upwardly of the conveyor by a suitable mounting means at a level in proximity to the opening of the molded container 1 passing the lower portion of the apparatus 20 and with the foremost end edge of the covering member 28 placed in proximity to the keep roll 29. It is to be noted that the gas substitution apparatus 20 may be designed so that the apparatus 20 is moved up and down in synchronism with the movement of the conveyor.

Reference numeral 19 designates a drawing chain for the carrier conveyor 2.

Figure 8:
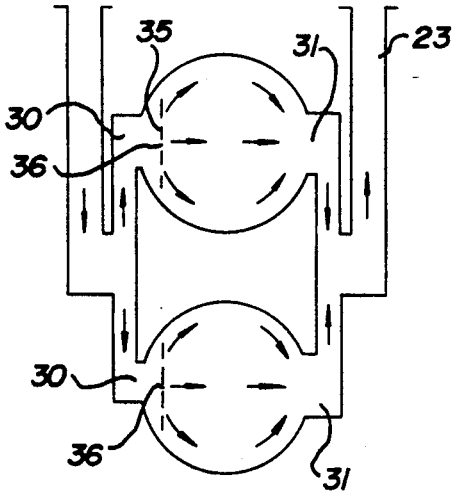
FIG. 8 is a plan sectional view of another embodiment of an inert gas substitution apparatus.
Figure 9:
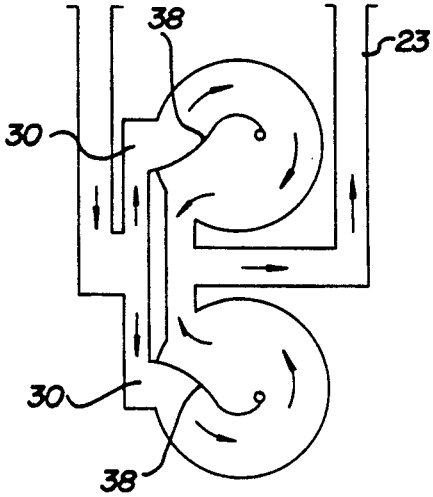
FIG. 9 is a plan sectional view of another embodiment of an inert gas substitution apparatus.

FIGS. 8 and 9 show another embodiment in which a gas flowpassage within the chamber 21 is modified.

In the FIG. 8 embodiment, a diffusion plate 35 provided with a striped vent hole 36 in the vicinity of an inert gas blow opening 30 is provided suspended from the top wall. Thereby, the inert gases blown out of the gas blow opening 30 are evenly blown in a diffusion flow into the head space.

In the FIG. 9 embodiment, a gas flow deflecting plate 38 curved from the gas blow opening to a portion in the vicinity of a central portion of a can opening is suspended from the top wall. According to the present embodiment, the inert gases blown out of the gas blow opening 30 make a round travel while flowing along the peripheral walls of the chamber and molded container, and therefore, air within the head space can be positively discharged, thus being effective in enhancing the substitution rate.

While in the above-described embodiment, the air exhaust path 23 is provided in communication with the air exhaust opening 31, it is to be noted that if a design is made so that air within the head space is directly discharged by the inert gases without using an exhaust device such as a vacuum pump, the aforesaid air exhaust path need not be provided.

While in the above-described embodiment, the inert gases are supplied while discharging air within the chamber and molded container by means of a vacuum pump, it is to be noted that air within the head space may be directly discharged by the inert gases blown into the container without using using the exhaust device such as a vacuum pump. In that case, the end of the air exhaust path is opened to atmosphere.

In the case where the contents are granular material, if the inert gases are supplied after air within the chamber and container has been sufficiently drawn by a vacuum pump, the gas substitution can be positively carried out.

Furthermore, while in the above-described embodiment, nitrogen is used as the inert gases, it is to be noted that if heated nitrogen is used, the cover of the container is inwardly stretched at normal temperatures to improve the external appearance of a package. This is particularly effective in case of a cold package.

INDUSTRIAL AVAILABILITY

This invention can be utilized for a gas substitution packaging in which in filling a plastic molded cntainer with a content and sealing an opening with a cover material film, sealing and packaging are effected after substitution of an inert gas such as nitrogen for a gas such as air within the container in order to prevent oxidization of the content.

We claim:

1. An inert gas substitution apparatus for non-sealed opened top containers filled with a content, said apparatus including a conveyor for moving said containers one container after the other, with the contents filled therein, to a gas substitution station and, from said gas substitution station, to a container covering station immediately adjacent to said gas substitution station and for stopping said container in each said station, said gas substitution station having a stationary plate means with a flat bottom surface and having a bottom area for covering said opened top of said container and for allowing edges of said opened top of said container to smoothly slide across said plate flat bottom surface to thereby immediately transfer said container from said gas substitution station to said container covering station, said plate means having a leading edge portion which meets said container for directing said container opened top edges to move into abutting relationship with said plate flat bottom surface, said bottom area of said plate means having an inert gas blow opening therein for positioning in a central portion of said open top of said container and a plurality of air escaping holes spaced in said bottom area of said plate from said gas blow opening for positioning adjacent the inner peripheral wall of said opened top of said container, and an inert gas supply pipe connected to said inert gas blow opening for continuously supplying inert gas to said opening.

2. An inert gas substitution apparatus for a non-sealed opened top container filled with a content, said apparatus having a bottom-opened chamber with side walls and a top wall for covering said opened top of said container, said side walls having an inert gas blow opening and an air exhaust hole, and an inert gas supply pipe connected to said inert gas blow opening for continuously supplying inert gas to said gas blow opening, wherein a flat plate container-opening cover member extends outwardly of said chamber on a lower end of said side walls.

3. The inert gas substitution apparatus according to claim 2, wherein an inert gas flowpassage deflecting means for deflecting an inert gas flow into said container is provided on said top wall.

4. The inert gas substitution apparatus according to claim 2, wherein said air exhaust hole is communicated with a vacuum pump.

* * * * *